US005404158A

United States Patent [19]

Carlotta et al.

[11] Patent Number: 5,404,158

[45] Date of Patent: Apr. 4, 1995

[54] INK JET PRINTER MAINTENANCE SYSTEM

[75] Inventors: Michael Carlotta, Sodus; Kenneth W. Altfather, Fairport; Karai P. Premnath, Rochester, all of N.Y.

[73] Assignee: Xerox Corporation, Stamford, Conn.

[21] Appl. No.: 974,632

[22] Filed: Nov. 12, 1992

[51] Int. Cl.[6] ..... B41J 2/165

[52] U.S. Cl. ..... 347/32; 347/30; 251/9

[58] Field of Search ..... 346/140 R; 347/30, 32; 251/4, 6, 7, 9

[56] References Cited

U.S. PATENT DOCUMENTS

| | | | |
|---|---|---|---|
| Re. 32,572 | 1/1988 | Hawkins et al. | 156/626 |
| 3,791,767 | 2/1974 | Shill | 251/7 |
| 3,913,882 | 10/1975 | Moulet | 251/9 |
| 4,341,098 | 7/1982 | Otting | 251/7 |
| 4,364,065 | 12/1982 | Yamamori et al. | 346/140 R |
| 4,571,599 | 2/1986 | Rezanka | 346/140 R |
| 4,586,058 | 4/1986 | Yamazaki et al. | 346/140 R |
| 4,638,337 | 1/1987 | Torpey et al. | 346/140 R |
| 4,679,059 | 7/1987 | Dagna | 346/140 R |
| 4,746,938 | 5/1988 | Yamamori et al. | 346/140 R |
| 4,849,774 | 7/1989 | Endo et al. | 346/140 R |
| 4,853,717 | 8/1989 | Harmon et al. | 346/140 R |
| 4,855,764 | 8/1989 | Humbs et al. | 346/140 R |
| 5,138,343 | 8/1992 | Aichi et al. | 346/140 R |
| 5,257,044 | 10/1993 | Carlotta et al. | 347/32 |
| 5,339,102 | 8/1994 | Carlotta | 347/32 |

FOREIGN PATENT DOCUMENTS

| | | | |
|---|---|---|---|
| 0423475A1 | 4/1991 | European Pat. Off. | 346/140 R |
| 3220620A1 | 12/1983 | Germany | 346/75 |

*Primary Examiner*—Joseph W. Hartary

*Assistant Examiner*—John Barlow

*Attorney, Agent, or Firm*—Robert A. Chittum

[57] ABSTRACT

A maintenance station for an ink jet printer having a printhead with nozzles in a nozzle face and an ink supply cartridge is mounted on a translatable carriage for concurrent movement therewith. When the printer is in a non-printing mode, the carriage is translated to the maintenance station located outside and to one side of a printing zone, where various maintenance functions are provided depending upon the location of the carriage mounted printhead within the maintenance station. The printhead nozzle face is cleaned by at least one wiper blade as the printhead enters and leaves the maintenance station. Adjacent the wiper blade is a location for collecting nozzle-clearing ink droplets, followed by a capping location where a carriage actuatable cap moves into sealing engagement with the printhead nozzle face and surrounds the nozzle to provide a controllable environment therefor. A vacuum pump is interconnected to the cap by flexible hose with an ink separator therebetween. Priming is conducted when continued movement of the carriage mounted printhead actuates a pinch valve to isolate the separator from the cap and enable a predetermined vacuum to be produced therein by energizing the vacuum pump. Once the carriage mounted printhead returns to the capping location, the pinch valve is opened subjecting the printhead to the separator vacuum and ink is drawn from the printhead nozzle to the separator. Movement of the carriage mounted printhead past the wiper blade uncaps the nozzle face to stop the prime, enable ink to be removed from the cap to the separator and cleans the nozzle. The vacuum pump is de-energized and the printhead is returned to the capping location to await the printing mode of the printer.

11 Claims, 2 Drawing Sheets

INK JET PRINTER MAINTENANCE SYSTEM

BACKGROUND OF THE INVENTION

The present invention relates to ink jet printing apparatus and is concerned, more particularly, with the printing apparatus maintenance system for a printhead in such apparatus.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before initial use, to ensure that the printhead channels are completely filled with ink and contain no contaminants or air bubbles. After much printing and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938 while the removal of gas from the ink reservoir of a printhead during printing is described in U.S. Pat. No. 4,679,059.

It has been found that the priming operation, which usually involves either forcing or drawing ink through the printhead, can leave drops of ink on the face of the printhead and that, ultimately, there is a build-up of ink residue on the printhead face. That residue can have a deleterious effect on print quality. It has also been found that paper fibers and other foreign material can collect on the printhead face while printing is in progress and, like the ink residue, can also have a deleterious effect on print quality. It has previously been proposed, in U.S. Pat. No. 4,853,717, that a printhead should be moved across a wiper blade at the end of a printing operation so that paper dust and other contaminants are scraped off the orifice plate before the printhead is capped. It has also been proposed, in U.S. Pat. No. 4,746,938, that an ink jet printer should be provided with a washing unit which, at the end of a printing operation, directs water at the face of the printhead to clean the latter before it is capped.

SUMMARY OF THE INVENTION

It is an object of the present invention to provide a cost effective maintenance system which includes the functions of printhead nozzle capping, priming, cleaning, and refreshing, as well as waste ink management.

In the present invention, a maintenance station for an ink jet printer having a printhead with nozzles in a nozzle face and an ink supply cartridge is mounted on a translatable carriage for concurrent movement therewith. When the printer is in a non-printing mode, the carriage is translated to the maintenance station located outside and to one side of a printing zone, where various maintenance functions are provided depending upon the location of the carriage mounted printhead within the maintenance station. The printhead nozzle face is cleaned by at least one wiper blade as the printhead enters and leaves the maintenance station. Adjacent the wiper blade is a location for collecting nozzle-clearing ink droplets, followed by a capping location where a carriage actuatable cap moves into sealing engagement with the printhead nozzle face and surrounds the nozzle to provide a controllable environment therefor. A vacuum pump is interconnected to the cap by flexible hose with an ink separator therebetween. Priming is conducted when continued movement of the carriage mounted printhead to a predetermined location actuates a pinch valve to isolate the separator from the cap for a predetermined time and enable a predetermined vacuum to be produced therein by energizing the vacuum pump. Once the carriage mounted printhead returns to the capping location, the pinch valve is opened subjecting the printhead to the separator vacuum and ink is drawn from the printhead nozzle to the separator. Movement of the carriage mounted printhead past the wiper blade uncaps the nozzle face to stop the prime, enables ink to be removed from the cap to the separator and cleans the nozzle. The vacuum pump is de-energized and the printhead is returned to the capping location to await the printing mode of the printer. The predetermined time that the cartridge is at the pinch location and the predetermined time that the cartridge is at the capping location (as controlled by the controller software) determines pressure profiles and waste volumes. This control enables a spectrum of waste volumes and pressure profiles, two of which include: (a) cartridge initial install (longer wait at the capping location to prime all ink flow paths between the nozzles and the supply cartridge), and (b) refresh prime (shorter wait at the capping location to prime the printhead).

BRIEF DESCRIPTION OF THE DRAWINGS

By way of example, an embodiment of the invention will be described with reference to the accompanying drawings, wherein like numerals indicate like parts and in which.

DESCRIPTION OF THE PREFERRED EMBODIMENT

Figure 1:
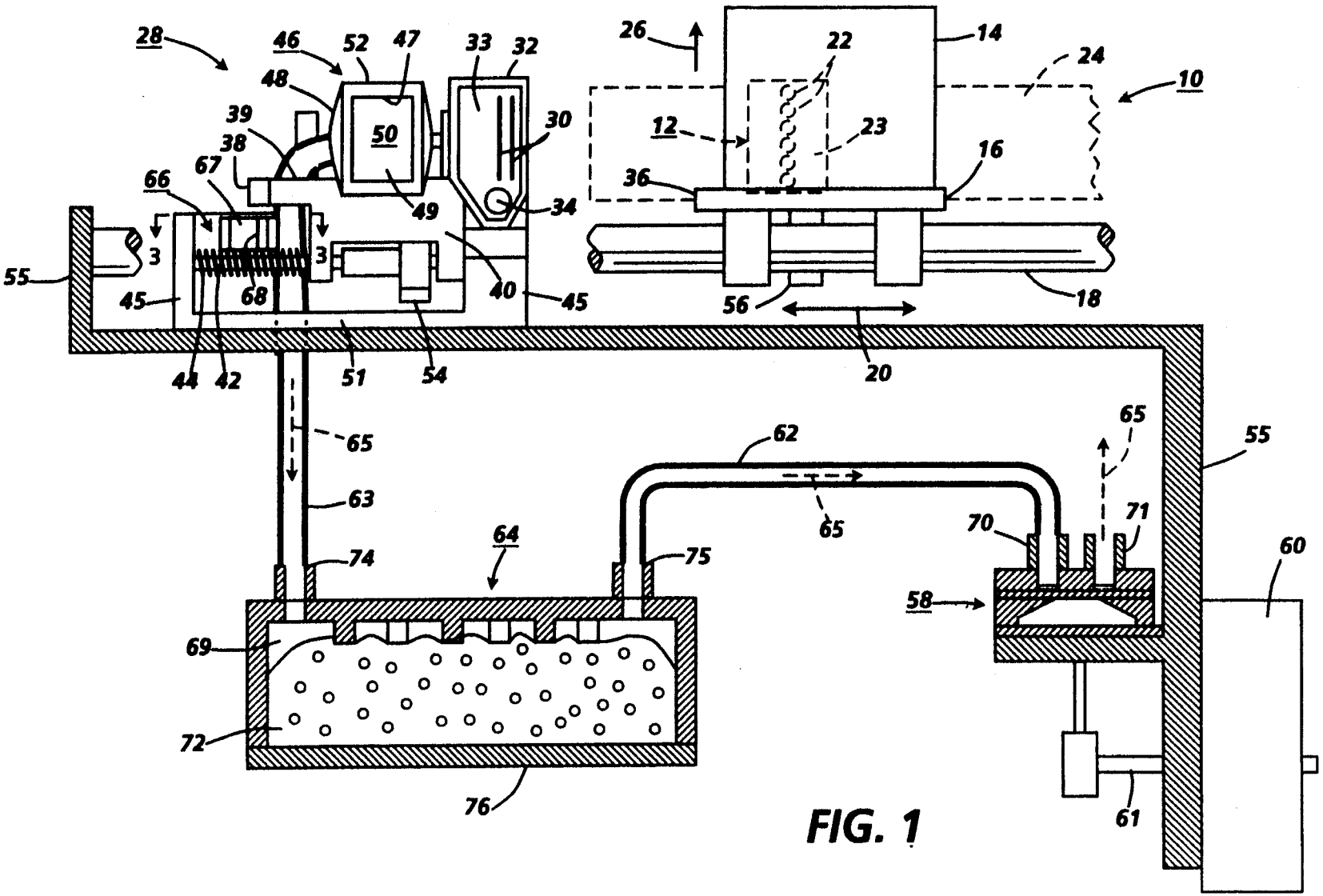
FIG. 1 is a schematic front elevation view of a partially shown ink jet printer having the maintenance station of the present invention.

The printer 10 shown in FIG. 1 has a printhead 12, shown in dashed line, which is fixed to ink supply cartridge 14. The cartridge is removably mounted on carriage 16, and is translatable back and forth on guide rails 18 as indicated by arrow 20, so that the printhead and cartridge move concurrently with the carriage. The printhead contains a plurality of ink channels (not shown) which terminate in nozzles 22 in nozzle face 23 (both shown in dashed line) and carry ink from the cartridge to respective ink ejecting nozzles 22. When the printer is in the printing mode, the carriage translates or reciprocates back and forth across and parallel to a printing zone 24 (shown in dashed line) and ink droplets (not shown) are selectively ejected on demand from the printhead nozzles onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, incorporated herein by reference.

At one side of the printer, outside the printing zone, is a maintenance station 28. At the end of a printing operation or termination of the printing mode by the printer 10, the carriage 16 is first moved past at least one fixed wiper blade 30 and preferably a pair of fixed, but separate, parallel, spaced wiper blades, so that the printhead nozzle face 23 is wiped free of ink and debris every time the printhead and cartridge (hereinafter print cartridge) enters or exits the maintenance station. Adjacent the wiper blade in the direction away from the printing zone and at a predetermined location along the translating path of the print cartridge is a fixedly mounted collection container 32. The carriage will position the print cartridge at this collection container, sometimes referred to as a spit station or spittoon, after the print cartridge has been away from the maintenance station for a specific length of time, even if continually printing, because not all nozzles will have ejected enough ink droplets to prevent the ink or meniscus in the little used nozzles from drying and becoming too viscous. Accordingly, the print cartridge will be moved by, for example, a carriage motor (not shown) under the control of the printer controller (not shown) past the printer blades, cleaning the nozzle face, and to the predetermined location confronting the collection container, whereat the printer controller causes the printhead to eject a number of ink droplets therein. In the preferred embodiment, the printhead will eject about 100 ink droplets into the collection container. Preferably, the wiper blade or blades are also located within the collection container so that ink may run or drip off the blades and be collected in the collection container. The collection container has a surface 33 which is substantially parallel to the printhead nozzle face and oriented in a direction so that the force of gravity causes the ink to collect in the bottom thereof where an opening 34 is located for the ink to drain therethrough into a pad of absorbent material (not shown) behind the collection container. The pad of absorbent material absorbs the ink and is partially exposed to the atmosphere, so that the liquid portion of the ink absorbed therein evaporates maintaining adequate ink storage volume for repeated subsequent cycles of priming and nozzle clearing droplet ejections.

When the carriage 16 continues along guide rails 18 beyond the collection container for a predetermined distance, the carriage actuator edge 36 contacts the catch 38 on arm 39 of the cap carriage 40. Cap carriage 40 has a cap 46 and is reciprocally mounted on guide rail 42 for translation in a direction parallel with the carriage 16 and print cartridge mounted thereon. The cap carriage is biased towards the collection container by spring 44 which surrounds guide rail 42. The cap 46 has a closed wall 47 extending from a bottom portion 48 of the cap to provide an internal recess 49 having a piece of absorbent material 50 therein. The top edge 52 of the wall 47 and preferably the outside surfaces of wall 47 including the top edge is covered by a resilient rubber like material 53, such as, Krayton®, a product of Shell Chemical Company, having a shore A durometer 45 to form a seal. In the preferred embodiment, resilient material 53 is molded onto the outside walls of wall 47. The cap is adapted for movement from a location spaced from the plane containing the printhead nozzle face to a location wherein the cap seal intercepts the plane containing the printhead nozzle in response to movement by the cap carriage. After the carriage actuator edge 36 contacts the catch 38, the print cartridge carriage and cap carriage move in unison to a location where the cap is sealed against the printhead nozzle face. At this location, the cap closed wall surrounds the printhead nozzles and the cap seal tightly seals the cap recess around the nozzles. During this positioning the cap against the printhead nozzle face, the cap carriage is automatically locked to the print cartridge by pawl 54 in cooperation with pawl lock edge 56 on the carriage 16. This lock by the pawl together with the actuator edge 36 in contact with catch 38 prevents excessive relative movement between the cap 46 and the printhead nozzle face 23.

Once the printhead nozzle face is capped and the cap is locked to the print cartridge, the printer controller may optionally cause the printhead to eject a predetermined number of ink droplets into the cap recess 49 and absorbent material 50 therein for the purpose of increasing humidity in the sealed space of the cap recess.

A typical diaphragm vacuum pump 58 is mounted on the printer frame 55 and is operated by any known drive means, but in the preferred embodiment, the vacuum pump is operated by the printer paper feed motor 60 through motor shaft 61, since this motor does not need to feed paper during printhead maintenance, and this dual use eliminates the need for a separate dedicated motor for the vacuum pump. The vacuum pump is connected to the cap 46 by flexible hoses 62, 63 and an ink separator 64 is located intermediate the cap and vacuum pump.

Figure 3:
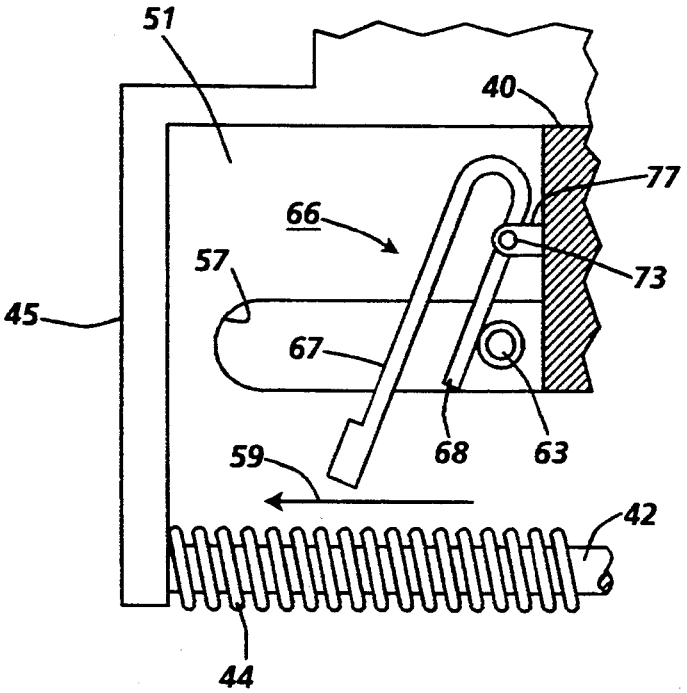
FIG. 3 is a partial cross-sectional view of the maintenance station as viewed along section line 3—3 in FIG. 1 showing the carriage actuated pinch valve.

The cap carriage guide rail 42 is fixedly positioned between fixed upstanding support members 43, 45 which extend from base 51 removably attached to the printer frame 55. Referring to FIG. 3, base 51 has an elongated slot 57 for passage of the flexible hose 63 and to accommodate movement of the flexible hose therein. A pinch valve 66 having a U-shaped structure is rotatably attached to the cap carriage 40 by a fixed cylindrical shaft 73 on leg 68 of the U-shaped structure, which is pivoted in flanges 77, so that movement of the cap carriage toward upstanding support member 45, as indicated by arrow 59, will eventually bring the other leg 67 of the U-shaped structure into contact with fixed support member 45, pinching the flexible tube 63 closed. The pinch valve is preferably of a uniform construction and of a plastic material. It is designed such that tolerances in print carriage positioning can be accommodated by deflections of pinch valve leg 67 which acts as a spring-beam. This beam deflection by leg 67 is designed to be within the stress limits of the material and, in the preferred embodiment, can tolerate ±0.8 mm mispositioning of the carriage from nominal pinch position.

Thus, at one predetermined location along guide rails 18 the print cartridge, through engagement of the carriage actuator edge 36 and catch 38 of the cap carriage, will cause the printhead nozzle face to be capped but the tube 63 will not be pinched shut. This will be referred to as the capped position, and the nozzle face is subjected to humidified, ambient pressure air through the cartridge vent (not shown) and vacuum pump valves 70, 71 through separator 64.

Figure 2:
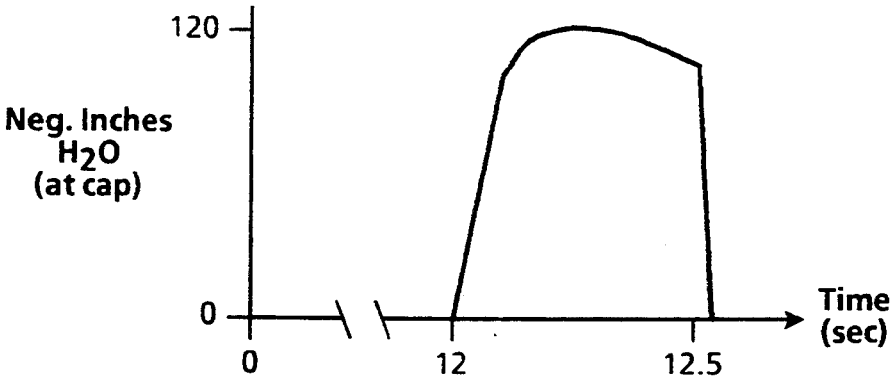
FIG. 2 is a plot of the negative pressure in the cap of the maintenance station during the priming operation.

When it is necessary to prime the printhead, the carriage 16 is moved from the capped position towards fixed support member 45 until leg 67 of U-shaped pinch valve 66 contacts support member 45 causing the U-shaped pinch valve to rotate, so that leg 68 of the U-shaped structure pivots against flexible hose 63 and pinches it closed, i.e., pinch valve 66 is caused to close flexible hose 63 by movement of the carriage 16. Paper feed motor 60 is energized and diaphragm vacuum pump 58 evacuates separator chamber 69, partially filled with an absorbent material, such as reticulated polyurethane foam 72, to a negative pressure of about minus 120 inches of $H_2O$. This negative pressure is attained in about 10 seconds, depending on pump design. Meanwhile the cap recess is still at ambient pressure because of the pinch valve closure. When the desired separator negative pressure is achieved, after about 10 seconds, the carriage is returned to the location where the nozzle face is capped, but the flexible hose 63 is no longer pinched closed. At this point, the cap is still sealed to the printhead nozzle face and the pinch valve is opened thereby subjecting the sealed cap internal recess to a negative pressure of minus 120 inches of $H_2O$. The print cartridge remains at this position for about one second. This time period is determined to achieve a specific relationship of pressure in the cap and flow impedance of the ink through the nozzles and the maintenance system air volume in order to yield a priming target of 0.2 cc±0.05 cc of ink. The pressure curve measured while the printhead nozzle face is capped during the above described priming operation is shown in FIG. 2. The pinch valve pinches the flexible hose 63 closed at time zero seconds, and with the vacuum pump running, causes the pressure to begin dropping in the separator 64. The cap 46 is sealed to the printhead nozzle face 23 and no pressure is reduced in the cap because the flexible hose is pinched closed. After about 12 seconds, the cap carriage 40 is allowed to move in a direction away from support member 45 under the urging of spring 44 and pawl 54, when the print cartridge carriage 16 is moved in a direction toward the wiper blade(s) 30, back to the capping position. At this point the pinch valve is open, about 12 seconds from flexible hose pinch off, and the negative pressure from the separator is introduced to the cap and ink is sucked from the nozzles. The negative pressure begins to drop due to the flow of ink. After about one second, the carriage 16 then moves breaking the cap seal and stopping the priming. The cap pressure drops and returns to ambient. The print cartridge is moved past the wiper(s) 30 to a hold position adjacent the wiper(s) at a location between the wiper(s) and the printing zone for a predetermined time period to wait while the ink and air are sucked or purged from the cap to the separator. When this has been accomplished, the carriage returns the print cartridge to the capped position to await for a printing mode command from the printer controller.

The predetermined time that the print cartridge is at a location where the flexible hose 63 is pinched closed and the predetermined time that the print cartridge is at the capped position (as controlled by the controller software) determines pressure profiles and waste volumes of ink. This control enables a spectrum of waste ink volumes and pressure profiles, two of which are when the print cartridge is initially installed (longer wait at the capped position to prime all ink flow paths between the nozzle and the supply cartridge and refresh or manual prime, discussed below (shorter wait at the capped position to prime the printhead).

Optionally, a manual prime button (not shown) is provided on the printer for actuation by a printer operator when the printer operator notices poor print quality caused by, for example, a nozzle that is not ejecting ink droplets. This manual priming by actuation of the manual prime button works substantially the same way as the automatic prime sequence described above, which is generally performed when the print cartridge is installed or any other sensed event which is programmed into the printer controller. The only difference is that the amount of lapsed time is reduced to 0.5 seconds after the pinch valve is opened to reduce the amount of ink sucked from the print cartridge to about 0.1 cc to reduce waste ink and prevent reduced printing capacity per print cartridge. Occasionally, a manual refresh prime may not be sufficient to improve print quality. Therefore, the controller with appropriate software would invoke the initial prime volumes after continued attempts were made to recover via manual refresh prime. For example, after two consecutive manual refresh prime attempts within a two minute period, the third attempt would be made by the printer controller at initial prime ink volumes.

While the cap is being purged of ink and the print cartridge is in the hold position, the paper feed motor is operating the vacuum pump to pump air and ink from the cap into the separator. Once in the separator, the ink is absorbed by the foam which stores the ink and prevents ink from entering the pump. (Ink in the pump could damage pump valves.) Above the separator foam is a chamber having a serpentine air passageway which connects the inlet 74 and outlet 75 which deters ink ingestion by the pump. The floor 76 of the separator is made of a material that is strategically selected for its Moisture Vapor Transfer Rate (MVTR). During months of use, fluid will be lost through this migration phenomena. Any time the paper feed motor is turning for any reason other than maintenance, the print cartridge must be away from the cap, otherwise unwanted ink would be drawn into the cap. When the paper feed motor is turning for reasons other than maintenance, and the printer cartridge is away from the cap, the pump operates and continues to pump air through the maintenance station system purging ink from the cap to the separator. This provides extra insurance which prevents ink from collecting in flexible hose 63, drying and blocking flow therethrough.

Many modifications and variations are apparent from the foregoing description of the invention, and all such modifications and variations are intended to be within the scope of the present invention.

We claim:

1. A maintenance station for an ink jet printer having a printhead with nozzles in a nozzle face and an ink supply cartridge, the printhead and the ink supply cartridge being mounted on a translatable carriage for concurrent movement with the translatable carriage, the translatable carriage being translated across and parallel to a printing zone for printing ink droplets ejected on demand from printhead nozzles onto a recording medium in the printing zone, when the printer is in a printing mode, and the translatable carriage being translated to the maintenance station located outside the printing zone and to one side thereof when the printer is in a non-printing mode, the maintenance station comprising:

at least one fixedly mounted wiper blade for cleaning the printhead nozzle face when the translatable carriage is translated to and from the maintenance station;

a fixedly mounted ink droplet collection container being spaced from the printhead for collecting nozzle-clearing ink droplets periodically ejected from the printhead nozzles for the purpose of keeping fresh ink in said nozzles;

a carriage actuatable cap having a closed wall extending from a bottom portion of the cap to provide a recess, the cap wall having a top edge covered by a seal, the cap being adapted for movement from a first cap location spaced from the printhead nozzle face to a second cap location in which the cap wall seal surrounds and seals the nozzles in the printhead nozzle face in response to movement of the translatable carriage to a first position in the maintenance station;

a vacuum pump;

means for operating the vacuum pump to prime the printhead through the cap when the cap is in the second cap location by removal of ink and air from the printhead or to evacuate ink from the cap when the cap is in the first cap location;

an ink separator located intermediate the vacuum pump and the cap, the separator having an absorbent material for the removal and storage of ink and a chamber above the absorbent material for the separation of air from the ink and the passage of the air through and out of the separator;

flexible hose interconnecting the vacuum pump to the separator and separator to the cap; and valve means located adjacent the cap for crimping the flexible hose between the separator and the cap to isolate the cap from a vacuum formed by the vacuum pump in the separator when the translatable carriage is moved to a second position in the maintenance station, the valve means being actuated to crimp the flexible hose in response to the movement of the translatable carriage from the first position in the maintenance station to the second position in the maintenance station.

2. The maintenance station of claim 1, wherein the ink droplet collection container has a front surface and a back surface, the collection container front surface being confrontingly spaced from the printhead nozzle face when the printhead elects ink droplets into the collection container to collect the elected ink droplets, the collection container front surface is oriented to enable the force of gravity to cause the collected ink therein to move to and accumulate in a lower portion thereof; wherein the lower portion of the collection container front surface has an opening which penetrates the back surface for draining any accumulated ink; and wherein a pad of absorbent material is mounted adjacent the collection container back surface and in contact with the collection container opening for absorbing and evaporating ink from said collection container.

3. The maintenance station of claim 2, wherein the at least one wiper blade is located in the collection container.

4. The maintenance station of claim 1, wherein the cap is movably mounted on a cap carriage which is movable on at least one fixed guide rail parallel to the direction of movement of said translatable carriage; wherein the cap carriage has an arm with a catch; wherein the translatable carriage has an actuator edge positioned to contact the cap carriage catch during translation thereof to cause the cap carriage to move in unison with said translatable carriage; and wherein the valve means is pivotally mounted to the cap carriage, so that the unison movement of the cap carriage and the translatable carriage from the first position to the second position in the maintenance station causes the valve means to pivot and crimp the flexible hose.

5. The maintenance station of claim 4, wherein the maintenance station further comprises means to cause the cap on the cap carriage to move from the first cap location spaced from the printhead nozzle face to the second cap location in which the cap seals the nozzles when the cap carriage and translatable carriage move in unison to the first position in the maintenance station.

6. The maintenance station of claim 5, wherein the means for operating the vacuum pump is a motor energized to operate said vacuum pump when the translatable carriage is at the second position in the maintenance station and the flexible hose is crimped by the valve means, thereby isolating the cap from the separator; and wherein the separator is evacuated by the vacuum pump to a predetermined negative pressure.

7. The maintenance station of claim 6, wherein the predetermined negative pressure in the separator is about minus 120 inches of $H_2O$.

8. The maintenance station of claim 6, wherein the translatable carriage is moved from the second position to the first position in the maintenance station pivoting the valve means to uncrimp the flexible hose and yet maintain the cap sealed around the printhead nozzles, so that the cap is suddenly subjected to the negative pressure in the separator which causes ink with any air therein to be sucked from the printhead nozzles through the cap to the separator, thereby priming said printhead.

9. The maintenance station of claim 9, wherein the cap contains an absorbent material therein for the purpose of holding ink to increase humidity in the cap when the cap is sealed against the printhead nozzle face; and wherein the printhead may eject a predetermined number of ink droplets into the cap and absorbent material to place ink in the absorbent material.

10. The maintenance station of claim 8, wherein the translatable carriage is moved to a location to cause the cap on the cap carriage to return to the first cap location spaced from the printhead nozzle face and stop the priming of the printhead; and wherein the vacuum pump continues to operate and remove the ink accumulated in the cap during the priming of the printhead and direct the ink into the separator.

11. The maintenance station of claim 8, wherein pressure profiles and volumes of ink removed from the printhead during priming are variable, depending upon time periods at the first and second positions of the cap carriage and translatable carriage in the maintenance station.

* * * * *